US007760054B2

(12) United States Patent
Lewellen et al.

(10) Patent No.: US 7,760,054 B2
(45) Date of Patent: Jul. 20, 2010

(54) TUBULAR RF CAGE FIELD CONFINEMENT CAVITY

(75) Inventors: John W. Lewellen, Willowbrook, IL (US); John Noonan, Naperville, IL (US); Terry L. Smith, Plainfield, IL (US); Geoff Waldschmidt, Bolingbrook, IL (US)

(73) Assignee: UChicago Argonne, LLC, Chicago, IL (US)

( * ) Notice: Subject to any disclaimer, the term of this patent is extended or adjusted under 35 U.S.C. 154(b) by 699 days.

(21) Appl. No.: 11/747,021

(22) Filed: May 10, 2007

(65) Prior Publication Data

US 2008/0042784 A1 Feb. 21, 2008

Related U.S. Application Data

(60) Provisional application No. 60/818,472, filed on Jul. 3, 2006.

(51) Int. Cl.
*H01P 7/06* (2006.01)

(52) U.S. Cl. ..... 333/227; 333/231; 333/235; 372/29.022; 315/5.16; 315/501

(58) Field of Classification Search ..... 333/227, 333/219, 197, 226, 223, 231, 233, 235; 372/29.022, 372/32; 315/500, 501, 505, 506, 5.16, 5.42
See application file for complete search history.

(56) References Cited

U.S. PATENT DOCUMENTS 2,474,420 A * 6/1949 Himmel ..... 219/778
4,540,960 A 9/1985 Giordano
4,992,737 A * 2/1991 Schnur ..... 324/318
5,500,995 A * 3/1996 Palmieri et al. ..... 29/599
6,417,622 B2 * 7/2002 Theiss ..... 315/3.5

OTHER PUBLICATIONS

E. Yablonovitch, T.J. Gmitter, and K.M. Leung, Physical Review Letters 67, 2295 (1991).

J.R. Sirigiri, K.E. Kreischer, J. Machuzak, I. Mastovsky, M.A. Shapiro, and R.J. Temkin, Physical Review letters 86, 5628 (2001).

K.C.D. Chan, R.H. Kraus, J. Ledford, K.L. Meier, R.E. Meyer, D. Nguyen, R.L. Sheffield, F.E. Sigler, L.M. Young, T.S. Wang, W.L. Wilson, and R.L. Wood, Nuclear Instruments and Methods in Physics A138, 148 (1992).

* cited by examiner

*Primary Examiner*—Haissa Philogene
(74) *Attorney, Agent, or Firm*—Joan Pennington

(57) ABSTRACT

An RF cavity is provided with a plurality of tubes that are formed into a tubular cage in a predefined shape to define the RF cavity. A selected number of tubes and a selected tube diameter are provided to form a confinement cage for the RF fields within the RF cavity defined by the tubes. The multiple, small metal tubes are selectively bent to form different cavity shapes and sizes as needed to accelerate the particles and function as a confinement cage for the RF fields within the RF cavity defined by the tubes. The cost to fabricate RF cavities using the tubular cage design is significantly lower than the cost of producing a solid cavity using conventional fabrication technology.

18 Claims, 5 Drawing Sheets

TUBULAR RF CAGE FIELD CONFINEMENT CAVITY

This application claims the benefit of U.S. Provisional Application No. 60/818,472, filed on Jul. 3, 2006.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

The present invention relates to an improved radio frequency (RF) cavity, and more particularly to an improved design and method of fabrication of an RF cavity.

DESCRIPTION OF THE RELATED ART

RF cavities are used to produce very high RF fields to accelerate particles to high energy levels. Present technology confines the fields and encases the ultra-high vacuum environment with a solid metal vessel. With present technology, optimizing the design for RF cavities is a compromise between RF properties, such as accelerating gradient, and mechanical and electrical properties, such as vacuum level, cavity tuning, and the like. The conventional RF cavity, may or may not be superconducting, and is made of a solid metal surface that encloses a volume, such as a metal cylinder. The solid vessel forms the RF cavity. It is also the enclosure that maintains an ultra-high vacuum environment. Typically, the same physical structure is used for both cavity and vacuum containment; alternately, the RF cavity may be placed inside of a separate ultra-high vacuum containment system.

At present, these vessels are constructed of either copper for room temperature applications or niobium for superconducting applications. These cavities are difficult to manufacture. The solid cavity designs can be very expensive to produce due to material costs and fabrication complexity.

The solid cavity design also results in limited access into the cavities for coupling power, diagnostics, damping, and vacuum pumping. Ports on the cavity body at discrete locations are required to permit access into the cavity. The ports usually degrade the RF performance of a completely solid cavity. The design of a conventional cavity is a compromise between RF gradient, vacuum, diagnostics, parasitic mode damping, and thermal requirements.

U.S. Pat. No. 4,540,960, issued Sep. 10, 1985 to Salvatore Giordano, discloses a radio frequency resonant cavity having a fundamental resonant frequency and characterized by being free of spurious modes. A plurality of spaced electrically conductive bars is arranged in a generally cylindrical array within the cavity to define a chamber between the bars and an outer solid cylindrically shaped wall of the cavity. A first and second plurality of mode perturbing rods are mounted in two groups at determined random locations to extend radially and axially into the cavity thereby to perturb spurious modes and cause their fields to extend through passageways between the bars and into the chamber. At least one body of lossy material is disposed within the chamber to damp all spurious modes that do extend into the chamber thereby enabling the cavity to operate free of undesired spurious modes.

Disadvantages are that the disclosed radio frequency resonant cavity is limited to a simple cylindrical geometry and the use of coolant to allow high power RF operation is not enabled. In addition, it would be cumbersome to assemble multiple Giordano cells into a multiple cell cavity. Finally, the Giordano cavity cannot sustain a high quality factor, Q, the ratio of the resonance frequency to the half-power bandwidth.

Photonic Band Gap (PBG) Resonator structures are disclosed by E. Yablonovitch, T. J. Gmitter, and K. M. Leung, "Photonic Band Structure: The Face-Centered-Cubic Case Employing Nonspherical Atoms," Physical Review Letters 67, 2295 (1991); and R. Sirigiri, K. E. Kreischer, J. Machuzak, I. Mastovsky, M. A. Shapiro, and R. J. Temkin, "Photonic-Band-Gap Resonator Gyrotron," Physical Review Letters 86, 5628 (2001).

A photonic band gap structure is a configuration, which has a periodically varying dielectric constant in at least one direction and is uniform in all other directions. A two-dimensional structure is the most relevant to the fabrication of an RF cavity of the present invention. The two-dimensional structure is a lattice of long, parallel rods that are terminated by metallic end plates. The rods could be metal or a dielectric material. The essential characteristic of a periodically varying dielectric medium is that regions of frequency exist for which no propagating modes are present for waves traveling in a particular set of directions in the lattice.

An accelerating structure is created by removing a rod at the center of the array, thus introducing a defect into the array. The beam can be transmitted along the hole created by removing the rod. The beam field is confined to the central path defined by the defect because no propagating modes are allowed transverse to the beam central axis. Although the PBG structure is superficially similar to the monochromatic resonator, it operates in a much different mode. The PBG structure is a traveling wave structure based on a distributed periodic array of elements (rods). The monochromatic resonator and the cage field confinement cavity are electromagnetic resonant cavities.

Researchers at Los Alamos National Laboratory have fabricated a multi-cell linear accelerator with integrated electron source, for example, as disclosed by K. C. D. Chan, R. H. Kraus, J. Ledford, K. L. Meier, R. E. Meyer, D. Nguyen, R. L. Sheffield, F. E. Sigler, L. M. Young, T. S. Wang, W. L. Wilson, and R. L. Wood, "Los Alamos advanced free-electron laser," Nuclear Instruments and Methods in Physics A138, 148 (1992). The vacuum pressure in the cavity limited cavity operation. The researchers cut slots in the resonant cavity to increase the gas conductance out of the cavity, and therefore, to lower the pressure. This required a new, outer vacuum vessel. Although the cavity pressure was improved, the quality factor of the cavity was reduced. The slotted cavity is most similar to the monochromatic resonator, except that there was no effort to damp higher order modes that are excited in the cavity. The slotted cavity was also limited in the amount of RF power that could be introduced to the cavity.

Principal aspects of the present invention are to provide an improved design and method of fabrication of an RF cavity.

Other important aspects of the present invention are to provide such improved design and method of fabrication of an RF cavity substantially without negative effect and that overcome some of the disadvantages of prior art arrangements.

SUMMARY OF THE INVENTION

The present invention uses a plurality of rods to form a defined volume that functions as a cavity for microwaves with frequency below a critical frequency. The defined volume has the same fundamental shape as a conventional solid wall cavity, and has similar RF-related properties to the solid wall cavity. Importantly for the invention, frequencies above the cut-off frequency will be transmitted outside of the array of rods.

In brief, an RF cavity is provided with a plurality of tubes that are formed into a tubular cage in a predefined shape to define the RF cavity. A selected number of tubes and a selected tube diameter are provided to form a confinement cage for the RF fields within the RF cavity defined by the tubes. The spacing between the tubes determines the frequency of the RF fields that can be confined.

In brief, the present invention advances current technology by forming tubes into a three-dimensional shape that optimizes cavity properties, i.e. accelerating gradient, power quality factor, resonance frequency, multiple cell fabrication including multiple frequencies, and efficient cooling.

In accordance with features of the invention, the use of multiple, small metal tubes enables selectively bending to form different cavity shapes and sizes as needed to accelerate the particles and function as a confinement cage for the RF fields within the RF cavity defined by the tubes. The present invention is not limited to a simple cylindrical geometry of some known arrangements.

In accordance with features of the invention, improvements are provided over the monochromatic resonator and the Photonic Band Gap resonator. The cage cavity of the present invention includes rods that are three-dimensionally shaped that optimize the RF field profiles. The invention is not limited to an array of rods that are parallel to the beam axis, as both prior arrangements are limited, and the invention does not require a spatially distributed, periodic array with an engineered defect to produce the accelerating fields. The cage field confinement cavity is an improvement over the slotted cavity because the cavity shape can be optimized for vacuum, higher order mode suppression, accelerating gradient, quality factor, and RF input power.

In accordance with features of the invention, the tubular cage design is useful for both room temperature and superconducting cavity designs and offers substantial benefits to both applications. For room temperature cavities, the operation of RF cavities requires vacuum to avoid electric discharge, and a cage cavity cannot be evacuated due to its open character. Therefore the cage cavity is installed inside a simple vacuum enclosure. This feature of the cage cavity is the first advantage of the cavity. Due to the open structure of the rods, the ability to conduct gas from inside the cage is improved over solid wall cavities. There are no specifically designated ports within the rods, so very large pumps can be attached to the vacuum vessel without compromising the RF property of the cage cavity. In addition, diagnostic measurements and parasitic mode damping can be accomplished without compromising the cage RF cavity. An additional immediate benefit for cage cavities is the ability to provide co-linear power coupling and parasitic mode damping.

In accordance with features of the invention, the superconducting cage cavity has significant advantages over solid wall, superconducting cavities. For solid wall, superconducting cavities, the wall cannot be cut open to make vacuum ports, power coupling, etc except at the ends of the cavity. Therefore, power coupling, parasitic mode damping, and vacuum pumping must be done in series with the cavity. The particle beam cannot be accelerated in these areas, so extra length must be included to accommodate the required power coupling etc. The superconducting cage cavity advantageously is designed to be potentially collinear with the power coupling, high order mode (HOM) damping, and beam diagnostics. The fill factor, or accelerating gradient per unit length, is improved. The cage cavities potentially supply a better power coupling and result in a shorter accelerator, reducing the total length of the superconducting section, which reduces the construction cost significantly.

In accordance with features of the invention, a separate outer vacuum chamber surrounds the tubular cage. The tubular cage, for example, is formed into multi-cell cavities directly. The cost to fabricate RF cavities using the tubular cage design is significantly lower than the cost of producing a solid cavity using conventional fabrication technology. The quantity of niobium, for example, and the fabrication process provides a considerable savings and possible improved material purity compared to conventional fabrication from solid niobium.

In accordance with features of the invention, cooling advantageously is provided when required by flow through the center of the multiple, small metal tubes. Cavity fabrication is greatly enhanced by bending multiple, small metal tubes to form the RF confinement cage, being both easier and less expensive than producing a solid cavity using conventional fabrication technology. Cavity fabrication permits diagnostic instruments, vacuum ports, and the like to be placed anywhere in the vacuum vessel, coaxial to but outside of the small metal pipes that form the cavity, instead of only at the cavity ends as in a conventional solid cavity. Vacuum in the cavity is lower and more evenly distributed because of the large conductance between the rods. Cavity breakdown voltages should also be lower due to smaller surface area as compared to a conventional solid cavity.

In accordance with features of the invention, the superconducting cage cavity will have better vacuum properties than the solid wall cavity. Particles, such as dust, on the interior of the solid wall cavity will degrade the RF performance significantly. Since the cage cavity has an open structure, particles will simply fall between the tubes and out of the defined cavity region. Another vacuum problem for solid wall cavities is condensation of contaminants onto the solid wall when the cavities are cooled for superconducting operation. The cage cavity has improved performance for condensates by cooling other surfaces in the vacuum vessel before cooling the tubes for the cage cavity. The contamination will condense on the surfaces external to the cavity, leaving the cage surfaces cleaner. In contrast, when solid-wall cavities are cooled, contaminates condense directly onto the interior surface of the cavity.

In accordance with features of the invention, the present invention enables a high quality factor, Q, the ratio of the resonance frequency to the half-power bandwidth to be sustained. One of the principle purposes of the present invention is to fabricate high Q cavities.

In accordance with features of the invention, a cage cavity can be formed by interleaving two or more tube cages to form a cavity. If close spacing between rods is required at the large area of a cavity, the tubes could interfere at the small area of the cavity near the beampipe. To overcome this problem, tube shapes can be formed so that the tubes overlay in the small areas, but the tubes are aligned in the same plane at the large areas. In essence there are two, or more, cages interleaved to form the cavity. Advantages include improved RF performance due to the smaller spacing between tubes, and improved cooling since tube diameters do not have to be made smaller to accommodate closer spacings.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

A particularly important example of an RF cavity is the TESLA cavity that will be used in the proposed International Linear Collider (ILC). The TESLA cavities are solid wall, niobium cavities with a special ellipsoidal shape. The current design for ILC uses a "9-cell" structure that has the best RF performance. There will be 10's of thousands of the cavities installed in the ILC at an estimated cost in the 100's of millions of dollars. Because of this importance, models of cage cavities with the TESLA cavity profile as the volume defined by the cage were made and compared to solid-wall TESLA cavities.

The physics of a solid wall cavity is that the electromagnetic waves are reflected from the metal wall, i.e. a mirror. It is also known from electromagnetic theory that when a wave, such as a microwave, is incident on a series of equally spaced rods, that waves with frequency below a critical frequency and appropriate polarization (i.e. electric field aligned with the direction of the rods) will be reflected from the series of rods. Waves with frequencies above a critical frequency will be transmitted through the rods, as will waves with the wrong polarization.

The concept of the invention is to use the rods to form a defined volume that will act as a cavity for microwaves with frequency below the critical frequency. The defined volume has the same fundamental shape as a solid wall cavity, and has similar RF-related properties to the solid wall cavity. Importantly for the invention, frequencies above the cut-off frequency will be transmitted outside of the array of rods.

Figure 1:
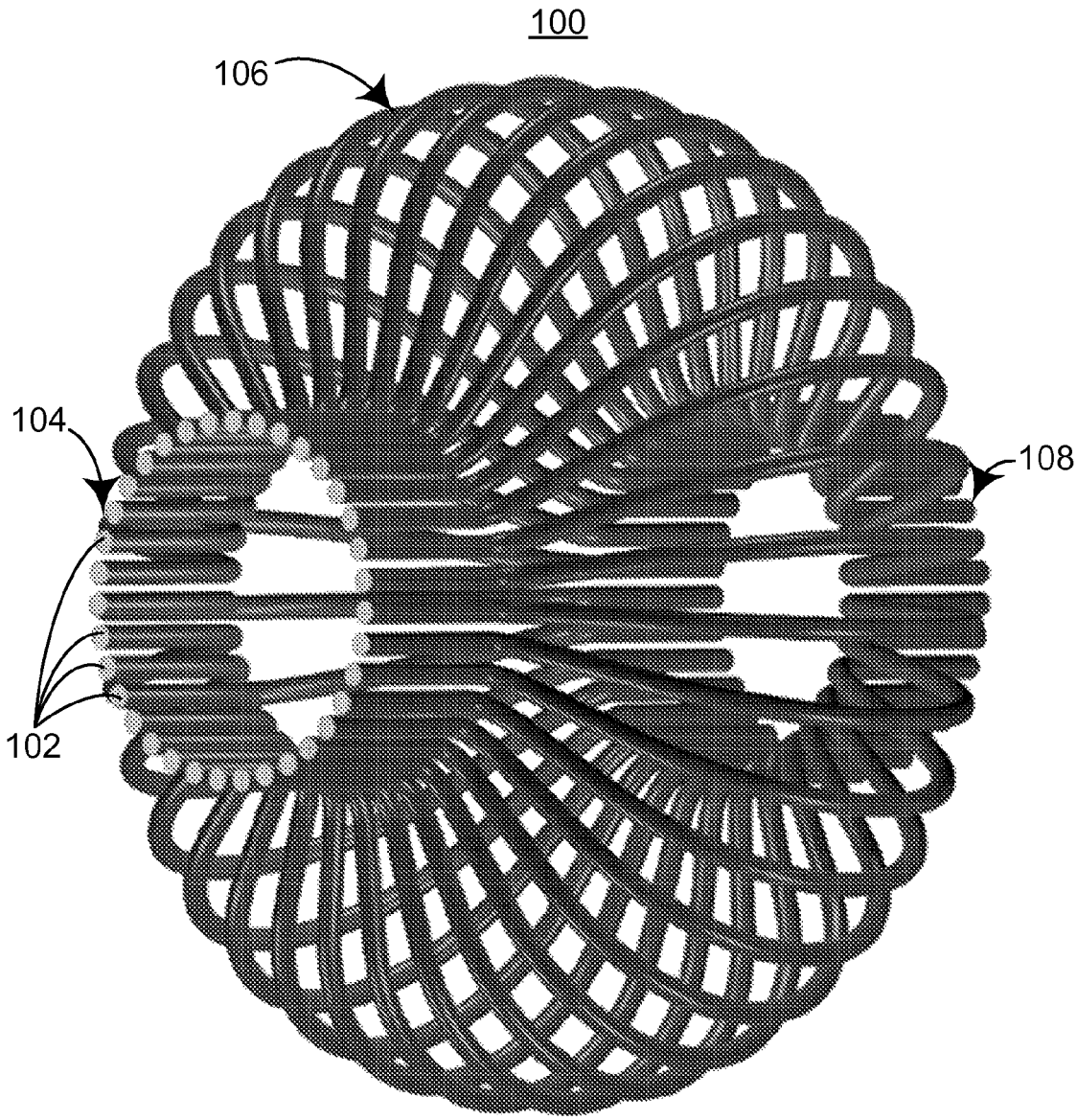
FIG. 1 is a perspective view illustrating a 44 tube, non-interleaved single-cell Tesla-type cavity in accordance with the preferred embodiment.

Having reference now to the drawings, in FIG. 1 there is shown a single-cell, Tesla-type RF cage cavity generally designated by the reference character 100 in accordance with the preferred embodiment. RF cage cavity 100 is a Tesla-type cavity formed by a plurality of tubes 102. The tubes 102 are small metal tubes that are formed to the shape of cavity 100, instead of using a standard solid surface Tesla cavity.

Figure 2:
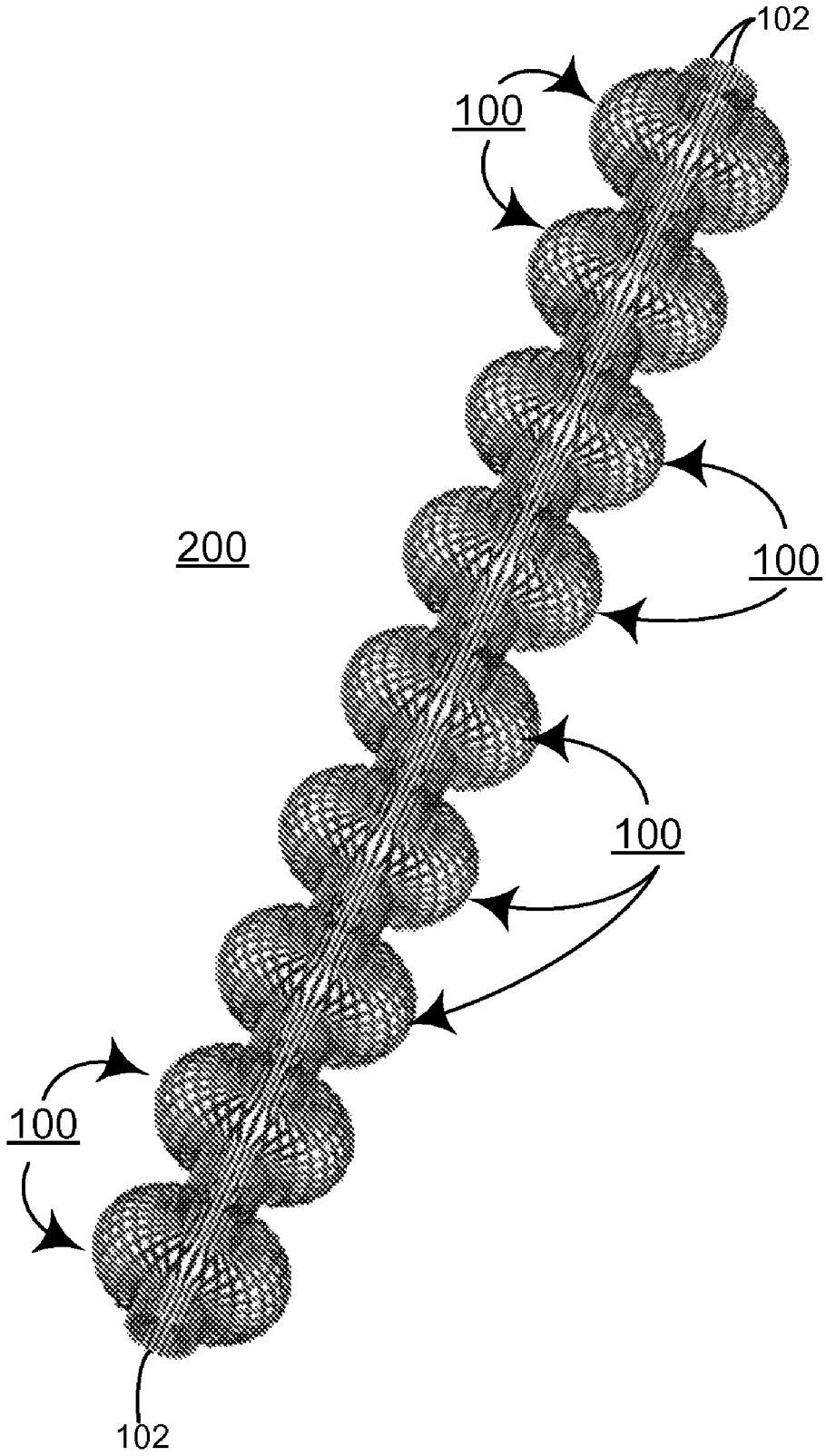
FIG. 2 is a perspective view illustrating a 9-cell TESLA-type RF tubular cage cavity formed using 40 tubes in accordance with the preferred embodiment.

By selecting the appropriate number of tubes 102 together with a selected tube diameter, the tubes form a confinement cage for the RF fields. The design of the tubular confinement cage 100 is suitable for both room temperature and superconducting cavity designs and offer substantial benefits to both applications. A room temperature, copper-cage cavity would have better vacuum properties due to the larger surface area of the access points along the RF-cage, as well as benefiting from possibly improved diagnostic capability. In addition to these benefits, a superconducting accelerating cavity could be designed to be collinear with the power coupling, HOM damping, and beam diagnostics. The fill factor, or accelerating gradient per unit length, is improved. The cage cavities, for example, as illustrated in FIG. 2, reduce the total length of the superconducting section, which reduce the construction cost significantly. The cost to fabricate RF cavities using the tubular cage design is significantly lower than the cost of producing a solid cavity using conventional fabrication technology. The quantity of niobium, for example, and the fabrication process would provide a considerable savings and possible improved material purity compared to fabrication from solid niobium.

Tubular RF confinement cage cavity 100 having a Tesla type shape includes a first iris 104, a central Tesla cavity body 106, and an opposite second iris 108. Separation between the small metal tubes 102 and the outer diameter size of the tubes 102 determines the cut-off frequency of a tubular confinement cage. Tubular RF confinement cage cavity 100 is inserted into a simple cylindrical vacuum vessel (not shown). Tubular RF confinement cage cavity 100 can be formed, for example, with 36 metal tubes having an outer diameter of 0.2 inch (0.2") and uniformly spaced to form the Tesla type cavity. The total number of metal tubes used is limited due to contact between the tubes at the iris FIG. 2 illustrates a multiple cell series of RF tubular cage Tesla-type cavities generally designated by the reference character 200 in accordance with the preferred embodiment. As shown, the multiple cell series of RF tubular cage Tesla-type cavities 200 includes nine (9) series connected RF tubular cage Tesla-type cavities 100 that advantageously are formed with a plurality of tube 102 directly into multi-cell cavities.

It should be understood that the present invention is not limited to the illustrated multiple cell series of RF tubular cage Tesla-type cavities 200. Another advantage is that different types of series connected RF tubular cage Tesla-type cavities 100 can be formed in the multi-cell configuration. For example, each RF tubular cage Tesla-type cavities 100 could be different in the 9-cell array. Other special cavity designs are possible, for example a 3rd harmonic cell could be formed and included into the 9-cell Tesla structure.

Figure 3:
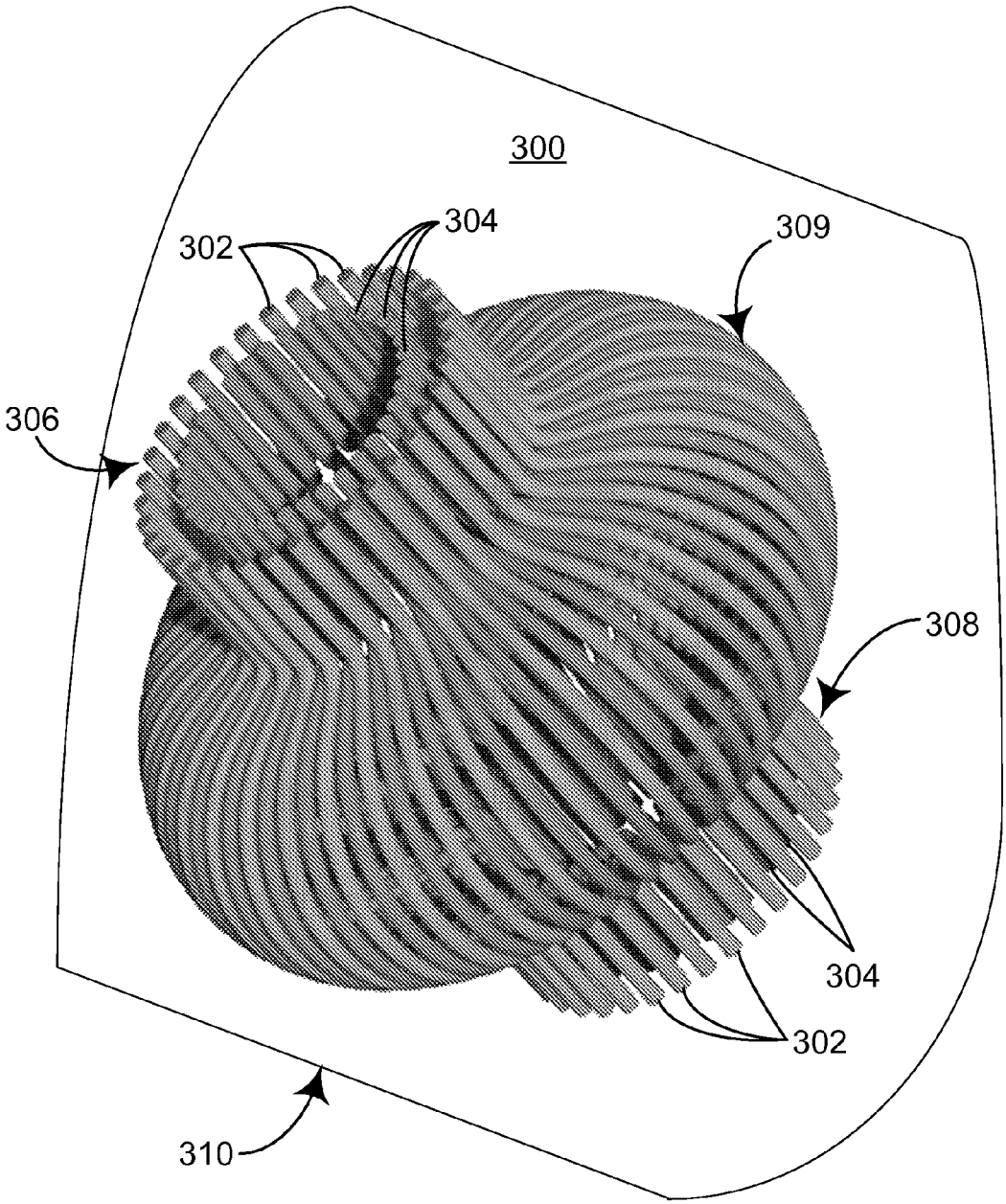
FIG. 3 is a perspective view illustrating a single-cell RF tubular cage Tesla-type cavity in which 60 tubes have been interleaved to form the cavity in accordance with another preferred embodiment.

FIG. 3 is a perspective view illustrating a single RF interleaved tubular cage Tesla-type cavity generally designated by the reference character 300 in accordance with another preferred embodiment. If a cage cavity was formed using 60 tubes instead of 36 as shown in FIG. 1, the tubes would interfere at the iris. The problem is resolved by forming half the tubes to have an iris that fits outside the first iris. The RF interleaved tubular cage Tesla-type cavity 300 includes a first plurality of tubes 302 interleaved with a second plurality of tubes 304. The tubes 302, 304 overlay in opposed small areas 306, 308, and the tubes 302, 304 substantially are aligned in the same plane at a generally central large areas 309. The RF interleaved tubular cage Tesla-type cavity 300 can be formed, for example, with 60 metal tubes having an outer diameter of 0.2 inch (0.2") and interleaved together to form the Tesla type cavity. The RF interleaved tubular cage Tesla-type cavity 300 is contained within a cylindrical vacuum vessel generally designated by the reference character 310. The RF interleaved tubular cage Tesla-type cavity 300 produces BMAX which is 50% to 75% larger as compared to a conventional solid-shell Tesla cavity design.

Tubular RF confinement cage cavities 100, 300 have been designed using copper Tesla cage cavity shape having a resonant frequency of about 1.3 GHz, and tested on a low power RF test station. A uniform RF confinement cage cavity 100 formed with 44 copper tubes having an 0.2" outer diameter and an interleaved RF confinement cage cavity 300 formed with 60 copper tubes having an 0.2" outer diameter have been simulated and compared with a conventional solid Tesla cavity as shown in Table 1 as follows:

TABLE 1

| | Conventional solid-wall | Uniform cage cavity 100 | Interleaved cage cavity 300 |
|---|---|---|---|
| Frequency | 1.29 GHz | 1.26 GHz | 1.28 GHz |
| Power loss | 486.5 kW | 699.6 kW | 530.6 kW |
| Quality factor (Q) | 29,900 | 21,377 | 27,146 |
| Emax | 22.4 MV/m | 28.9 MV/m | 30.2 MV/m |
| Bmax | 57.6 mT | 116 mT | 100 mT |

Two test cavities were fabricated including the uniform RF confinement cage cavity 100 formed with 44 copper tubes having an 0.2" outer diameter. The cavity resonant frequencies were measured at 1,255.567 MHz and 1,254.082 MHz. The difference between calculations and measurements is within 0.4%, and the difference between cavities is 0.12%, which shows significant reproducibility for the prototype cavities. The power loss factor Q is lower than calculated; material properties and measurement techniques likely are responsible for most of the difference.

Advantages apparent from the test tubular RF confinement cage cavities 100, 300 are that tuning is much easier. A conventional solid wall cavity is tuned either by forcing a ram into the cavity wall to deform the cavity or by stretching or compressing the cavity along its long axis, thereby changing its volume. The resonant frequency is related to the volume of the cavity. The volume of the tubular RF confinement cage cavities 100, 300 can be changed by either twisting the cavity, where one end is fixed and the other end is rotated about the central axis of the first, or where each tube 102, 302, 304 is rotated about its own axis. For example, the volume changes for 10° and 20° rotations of the tube about their axis are 0.994 and 0.975, respectively. The frequency shift for a 1% change of volume is approximately 13 MHz, so twisting the cage 100, 300 provides a sensitive frequency tuning mechanism. The twisting force is much less than the compressive force needed for solid wall tuning a typical 9-cell TESLA structure.

Tuning of multi-cell cavities, such as 9 cell series of RF tubular cage Tesla-type cavities 200 also is simple. A combination of stretching and twisting cells provides significant flexibility in tuning multi-cell cavities.

The cavity shape of tubular RF confinement cage cavities 100, 300 can be designed and formed to produce enhanced accelerating gradient without regard to fabrication limitations of conventional Tesla type The cavity shapes of tubular RF confinement cage cavities 100 and 300 can be designed and formed to produce enhanced accelerating gradient without regard to fabrication problems of liquid rinse cleaning as in conventional Telsa type elliptical shape cavity designs that must allow for fluid drainage. The coupling and higher order mode damping of tubular RF confinement cage cavities 100, 300 can be designed to provide enhanced performance.

Figure 4:
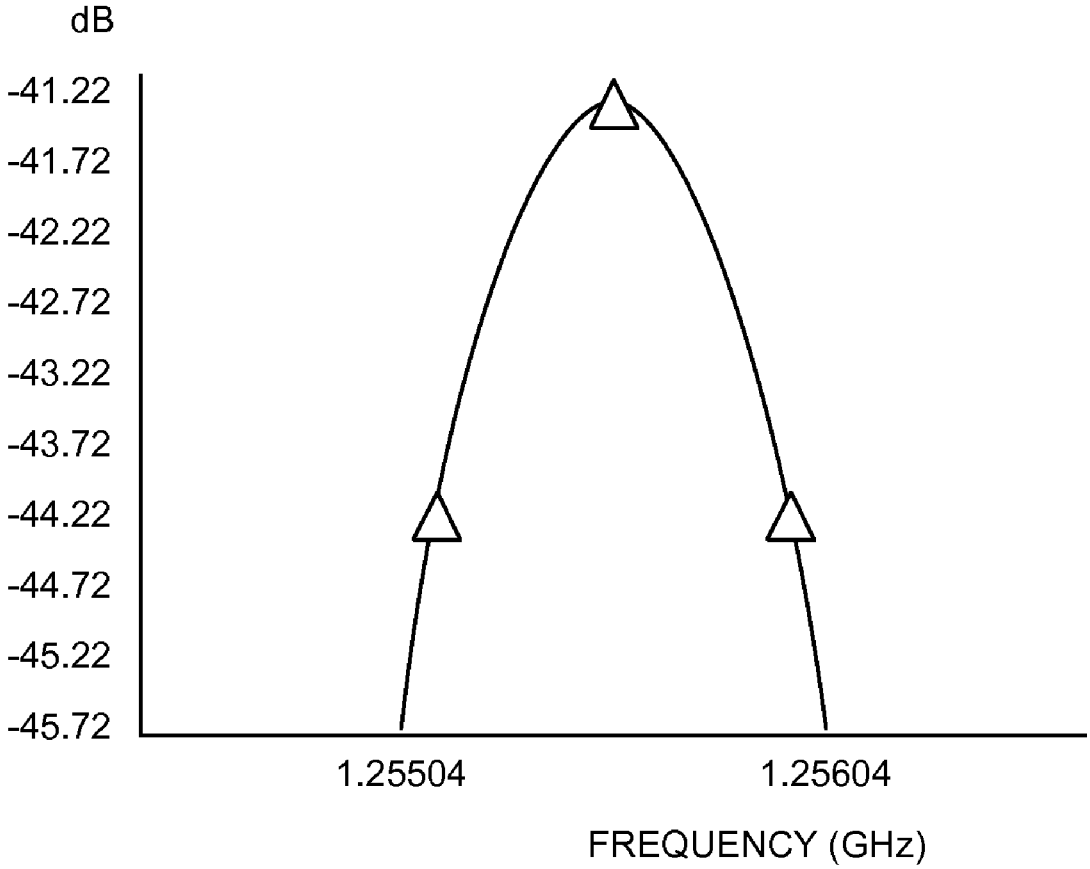
FIG. 4 is a chart illustrating the frequency response of a 40 tube, copper single-cell RF cage Tesla-type cavity of FIG. 1 in accordance with the preferred embodiment, where the cavities resonant frequency is 1.25505 GHz (compared to 1.26 GHz theoretical) and a cavity quality factor, Q, of 3,967.

FIG. 4 is a chart illustrating the frequency response of a 40 tube, single-cell RF cage Tesla-type cavity of FIG. 1 in accordance with the preferred embodiment. The chart shows that the cavities resonant frequency is 1.25505 GHz (compared to 1.26 GHz theoretical) and a cavity quality factor, Q, of 3,967.

Figure 5:
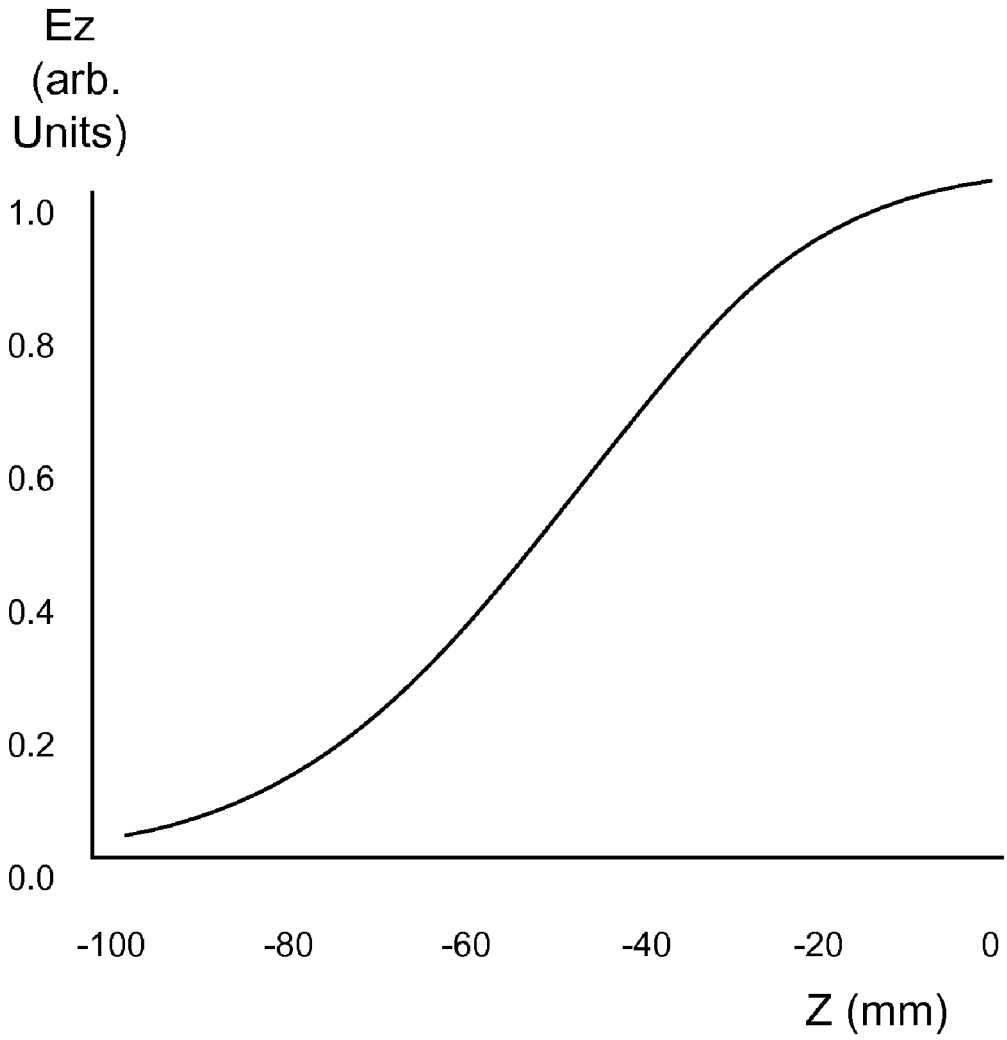
FIG. 5 is a chart illustrating simulated and measured performance of the on-axis electric field as a function of distance through the cavity for the 40 tube, single-cell RF cage Tesla-type cavity of FIG. 1 in accordance with the preferred embodiment.

FIG. 5 is a chart illustrating simulated and measured performance of the on-axis electric field as a function of distance through the cavity for the 40 tube, single-cell RF cage Tesla-type cavity of FIG. 1 in accordance with the preferred embodiment.

While the present invention has been described with reference to the details of the embodiments of the invention shown in the drawing, these details are not intended to limit the scope of the invention as claimed in the appended claims.

What is claimed is:

1. An RF cavity comprising:

a plurality of tubes, said plurality of tubes being formed into a tubular cage in a predefined shape to define the RF cavity;

said plurality of tubes having a selected number and a selected tube diameter forming a confinement cage for the RF fields within the RF cavity defined by the tubes;

said plurality of tubes including a plurality of small diameter metal tubes formed into said predefined shape for optimizing a plurality of predefined cavity properties; and said plurality of predefined cavity properties including a predetermined cooling efficiency provided by a cooling flow through said plurality of small diameter metal tubes.

2. The RF cavity as recited in claim 1 wherein said plurality of tubes includes a plurality of small diameter metal tubes.

3. The RF cavity as recited in claim 1 wherein said plurality of tubes is formed of copper.

4. The RF cavity as recited in claim 1 wherein said plurality of tubes is formed of niobium.

5. An RF cavity comprising:

a plurality of tubes, said plurality of tubes being formed into a tubular cage in a predefined shape to define the RF cavity;

said plurality of tubes having a selected number and a selected tube diameter forming a confinement cage for the RF fields within the RF cavity defined by the tubes; and said RF cavity being formed by interleaving at least two tubular cages, each of said tubular cages formed by a plurality of small diameter metal tubes.

6. The RF cavity as recited in claim 5 wherein said plurality of tubes includes a plurality of small diameter metal tubes formed into said predefined shape for optimizing a plurality of predefined cavity properties.

7. The RF cavity as recited in claim 6 wherein said plurality of predefined cavity properties includes a power quality factor.

8. The RF cavity as recited in claim 6 wherein said plurality of predefined cavity properties includes a resonance frequency.

9. The RF cavity as recited in claim 6 wherein said plurality of predefined cavity properties includes a multiple cell fabrication including multiple frequencies.

10. The RF cavity as recited in claim 6 wherein said plurality of predefined cavity properties includes an accelerating field gradient.

11. An RF cavity as recited in claim 5 wherein said plurality of small diameter metal tubes is formed of niobium.

12. An RF cavity as recited in claim 5 wherein said plurality of small diameter metal tubes is formed of copper.

13. An RF cavity comprising:

a plurality of tubes, said plurality of tubes being formed into a tubular cage in a predefined shape to define the RF cavity;

said plurality of tubes having a selected number and a selected tube diameter forming a confinement cage for the RF fields within the RF cavity defined by the tubes; and said predefined shape of said tubular cage including a Tesla type shape including a first iris, a central Tesla cavity body, and an opposite second iris.

14. An RF cavity as recited in claim 13 includes a multiple cell series of said tubular cages.

15. An RF cavity as recited in claim 13 wherein said RF cavity is formed by interleaving at least two tubular cages, each of said tubular cages formed by a plurality of small diameter metal tubes.

16. An RF cavity as recited in claim 15 wherein said at least two tubular cages are formed by overlaying said plurality of small diameter metal tubes in areas of said first iris and said opposite second iris.

17. An RF cavity as recited in claim 15 wherein said at least two tubular cages are formed by substantially aligning in a plane said plurality of small diameter metal tubes in an area of said central Tesla cavity body.

18. An RF cavity as recited in claim 14 wherein each of said multiple cell series of said tubular cages includes a Tesla type shape.

* * * * *